United States Patent [19]

Smith

[11] Patent Number: 4,928,884

[45] Date of Patent: May 29, 1990

[54] FLUID ASSIST AIRLESS SPRAY NOZZLE

[76] Inventor: Gary L. Smith, 2896 Tabago, Costa Mesa, Calif. 92626

[21] Appl. No.: 200,798

[22] Filed: Jun. 1, 1988

Related U.S. Application Data

[63] Continuation-in-part of Ser. No. 936,364, Dec. 1, 1986, Pat. No. 4,749,128.

[51] Int. Cl.[5] ..... B05B 7/08

[52] U.S. Cl. ..... 239/290; 239/422; 239/596

[58] Field of Search ..... 239/290, 292, 294, 296, 239/417.5, 422, 424.5, 527, 549, 566, 596, 600

[56] References Cited

U.S. PATENT DOCUMENTS

| | | | |
|---|---|---|---|
| Re. 31,163 | 3/1983 | Gardner | 239/527 X |
| 2,049,700 | 8/1936 | Gustafsson | 239/296 X |
| 2,070,696 | 2/1937 | Tracy | 239/296 X |
| 2,646,314 | 7/1953 | Peeps | 239/296 |
| 4,236,674 | 12/1980 | Dixon | 239/296 |
| 4,749,128 | 6/1988 | Smith | 239/527 X |

FOREIGN PATENT DOCUMENTS

| | | | |
|---|---|---|---|
| 539773 | 4/1957 | Canada | 239/296 |
| 354376 | 6/1961 | Switzerland . | |

*Primary Examiner*—Andres Kashnikow

*Assistant Examiner*—Kevin P. Weldon

*Attorney, Agent, or Firm*—Herb Boswell

[57] ABSTRACT

A fluid assist airless spray nozzle for spraying a plural component spray system has a nozzle plate having an airless discharge orifice located therein for spraying a first component of the plural component system as, for instance, a resin component. A first fluid discharge orifice is located on one side of the airless discharge orifice and a second fluid discharge orifice is located on the other. Outboard of the first fluid discharge orifice is a first gas discharge orifice and outboard of the second fluid discharge orifice is a second gas discharge orifice. The first component of the plural component system as, for instance, a resin is supplied to the airless discharge orifice and a second component of the system as, for instance, a catalyst is supplied to the first and second fluid discharge orifices. A gas is supplied to the first and second gas discharge orifices. The resin is discharged from the airless discharge orifice in a resin fan. Fluid from the first and second fluid discharge orifices are directed toward this fan such that the fluid impinges upon the fan and becomes incorporated therein and helps maintain the shape of the fan. Gas discharged from the first and second gas discharge orifices impinge upon the fan downstream from where the fluid impinges thereon and further shapes the fan.

22 Claims, 1 Drawing Sheet

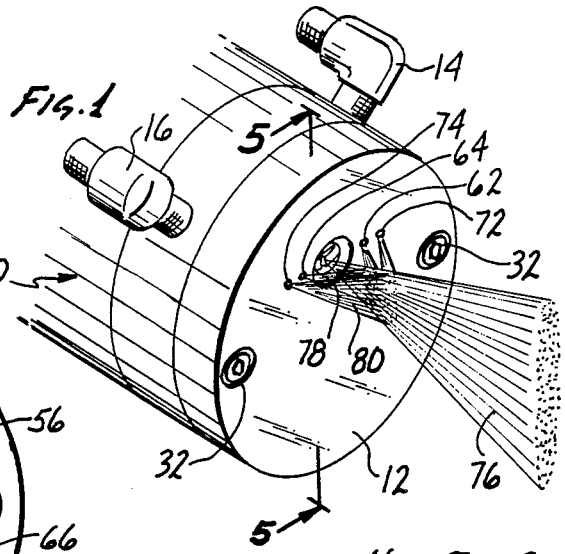
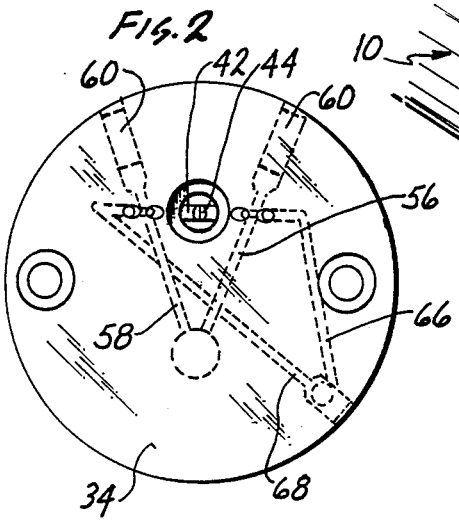
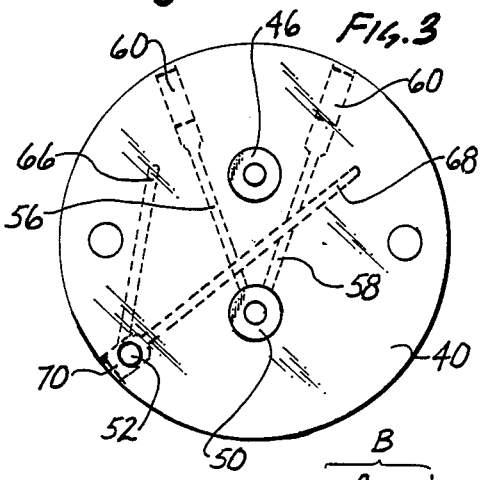
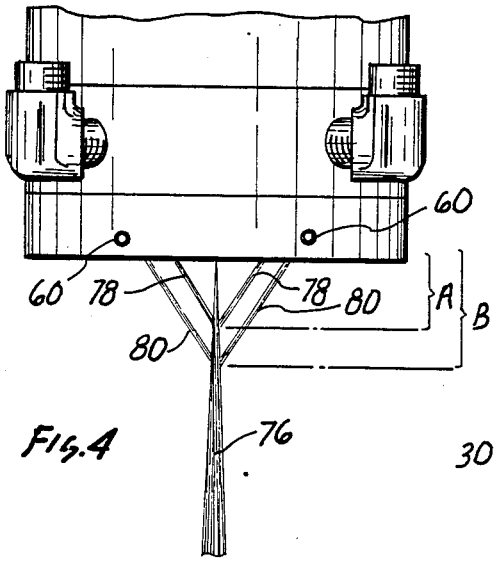
FIG. 4
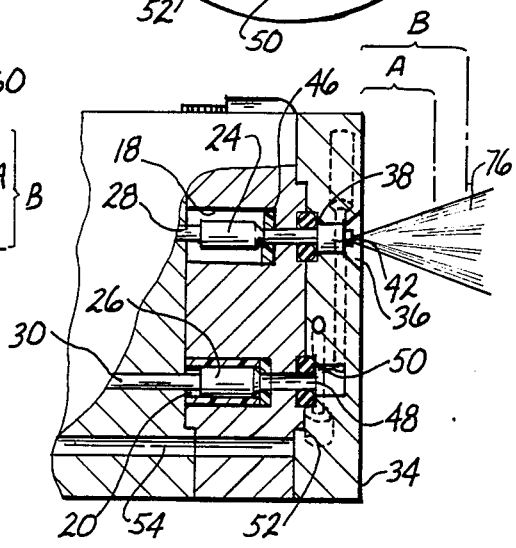
FIG. 5

FLUID ASSIST AIRLESS SPRAY NOZZLE

CROSS REFERENCE TO RELATED APPLICATION

This application is a continuation-in-part of my application SN 936,364, filed Dec. 1, 1986 entitled Spray Gun which was granted allowance as U.S. Pat. No. 4,749,128, dated June 7, 1988. The entire contents of application SN 936,364, are herein incorporated by reference.

BACKGROUND OF INVENTION

This application is directed to new and improved nozzles systems for plural component spray guns most particularly nozzle systems which utilize both a secondary fluid stream and a secondary gas stream, emitted from separate orifices, to assist in shaping a resin fan and to transfer catalyst to the resin fan.

A facile way of forming Fiberglas articles is achieved by spraying resin and catalyst precursor components of the Fiberglas against molds, mandrels and the like. A variety of spray devices have been devised for spraying of the Fiberglas components. Older spray systems utilize air to atomize and carry the resin and catalyst components from the spray gun. More modern devices utilize what is termed "airless" spraying.

In an airless spray device hydraulic pressure of a liquid component is utilized to propel the liquid component from the spray device and atomize the same. These airless systems have certain advantages over the older compressed air systems as, for instance, better control of the spray pattern and less dispersion on of the resin and catalyst components into the atmosphere.

Spray devices for spraying the resin and catalyst components of a plural component system can also be characterized as either achieving mixing of the catalyst into the resin within the interior of the spray device or exterior of the spray device. There are certain disadvantages with respect to interior mixing of the resin and catalyst components, since ultimately the catalyst causes polymerization of the resin. Because of polymerization, interior mixing devices are prone to clogging and therefore they must be cleaned out after each use prior to polymerization of the resin and catalyst.

If an operator is using such an internal mixing spray device and continuous ejection of the plural components from the gun is not maintained, when spraying is halted any mixed components remaining in the gun will polymerize. Thus, if the spray gun is not to be used for continuous operation it must be cleaned whenever spraying will be suspended for anything more than a short period of time. Cleaning is normally done by spraying an organic solvent such as acetone or the like through the interior of the spray device. This not only increase the economics of use of these devices, but present environmental hazards because of the evaporation of solvents into the work environment and into the atmosphere in general.

Additionally, if the components of the Fiberglas system are not maintained at equal pressures within the device mixing chamber one or the other of the components can contaminate the feed line of the other component. This can cause polymerization not only in the device mixing chamber but also in other areas of the device including the feed lines. Needless to say, when this happens a major clean up is necessary and in extreme cases the device can be rendered totally useless.

Externally mixing plural component spray devices eliminate the problems associated with internal mixing devices. They can, however, generate other problems. Since the catalyst is mixed with the resin exterior of the spray device inefficient mixing can occur and/or excessive amounts of toxic catalyst and the like can be lost to the atmosphere of the work environment. This is not only very uneconomical, but it is very hazardous to the operators of these devices.

In designing spray devices for plural components systems it is evident that consideration of many factors must be taken into account. In order to eliminate the use of excessive amounts of solvents and/or polymerization within the spray device, exterior mixing spray devices are preferred over interior mixing spray devices. In order to eliminate excessive vaporization of plural components, efficient low pressure airless devices are preferred over either high pressure airless devices and/or air sprays. In order to insure efficient mixing of catalyst and resin components and to achieve desirable flow patterns for applying uniform coats of the plural component system, proper choice of nozzle orientation, nozzle sizes and spray patterns must be considered. Additionally, in order to eliminate excessive waste and/or hazardous discharge of catalyst, resins and the like to the work place environment, the above nozzle characteristics as well as others must be taken into consideration An exterior mixing plural component spray device is shown in British Patent Specification No. 735,983, filed Sept. 14, 1953 in the name of Stanley Gustav Dehn. In this device resin is sprayed and is entrained within an enveloping air shroud. Catalyst is then injected into this enshrouded resin stream at a 90° angle to the ejection axis of the resin. This requires the catalyst stream to pass through an atomizing air barrier prior to mixing with the resin. As a result of this a significant amount of catalyst can be deflected into the atmosphere. Control of the spray pattern ejected from such a device is difficult because of the impinging angle of the catalyst stream on the air enshrouded resin stream.

A further external mixing plural component spray nozzle is shown in U.S. Pat. No. 4,618,098 dated Oct. 21, 1986 to Hedger et al. This patent contains a good summarization of prior spraying devices and problems associated with those devices in spraying the resin and catalyst components of Fiberglas systems. In this patent a nozzle system is shown which utilizes opposing air streams to initially shape a resin fan. After the fan is shaped by the air streams, catalyst steams are subsequently injected into the fan down stream from the air streams. Both the air stream and the catalyst stream are injected from "wings" which project forward out of the nozzle body. While this structure certainly is utilitarian, catalyst is still mixed into the resin fan several inches from the spray tip and the mixing is accomplished down stream from an initial air injection into the resin fan. Any rebound from the air stream hitting the resin fan would serve to disperse and distort the catalyst stream since it is ejected exterior of the air stream.

BRIEF DESCRIPTION OF THE INVENTION

In view of the above it is evident that while significant advances have been made with respect to improving the technology of spraying devices for plural component systems, problems still exist with these known devices. Therefore, it is a broad object of this invention to provide for a new and improved spray nozzles for plural component systems. Additionally it is an object of this invention to provide for new and improved spray nozzles which are both economical to manufacture and are engineered to facilitate maintenance of the same. Also it is an object of this invention to provide or spray nozzle systems and processes of operating spray nozzle systems which are based on airless discharge of a resin component and fluid assists for mixing catalyst into the resin component and for shaping the fan of the resin component.

These and other objects as will become evident from the remainder of this specification can be achieved in a nozzle system for a plural component spray gun which includes a nozzle plate having an airless discharge orifice located therein. First and second fluid discharge orifices are located in the nozzle plate in association with the airless discharge orifice with the first fluid discharge orifice located on one side of the airless discharge orifice and the second fluid discharge orifice located on the opposite side of the airless discharge orifice. Additionally, first and second gas discharge orifices are located in the nozzle plate in association with both the airless discharge orifice and the first and second fluid discharge orifices. The first gas discharge orifice is located adjacent to and outboard of the first fluid discharge orifice to position the first fluid discharge orifice between the first gas discharge orifice and the airless discharge orifice. The second gas discharge orifice is located adjacent to and outboard of the second fluid discharge orifice to position the second fluid discharge orifice between the second gas discharge orifice and the airless discharge orifice. The nozzle system further includes means for supplying a component of a plural component system to the airless discharge orifice, means for supplying a second component of the plural component system to the first and second fluid discharge orifices and means for supplying a gas to the first and second gas discharge orifice.

In an illustrative embodiment of the invention each of the first and second gas discharge orifices, the first and the second fluid discharge orifices and the airless discharge orifice are all aligned in a linear array on the nozzle plate with the gas discharge orifices being at the respective ends of the linear array, the airless discharge orifice at the center of the array and the fluid discharge orifices intermediate the respective ends and the center. Further, the nozzle plate can include an essentially smooth front surface with each of the respective orifices located in an opening in this smooth surface.

In an illustrative embodiment of the invention the front surface of the nozzle plate is flat. A first receiving orifice is formed in the back surface of the nozzle plate. This first receiving orifice is directly in line with the airless discharge orifice. Resin is conducted to the airless discharge orifice from the first receiving orifice. A nozzle insert can be included within the airless discharge orifice. The means for supplying the second component of the plural component system to the first and second fluid discharge orifices can include a second receiving orifice in the back surface and a fluid conduit means connecting the second receiving orifice to the first and second fluid discharge orifices. In like manner a third receiving orifice can be formed in the back surface and a gas conduit means can be utilized to connect the third receiving orifice to the first and the second gas discharge orifices on the front surface.

In a preferred process of the of the invention a plural component system can be sprayed by locating a resin orifice in a nozzle plate. First and second catalyst orifices are then located in the nozzle plate on respective sides of the resin orifices. Further, first and second gas orifices can be located in the nozzle plate on the respective sides of and outwardly from the first and second catalyst orifices such that the respective orifices are aligned in an array on the nozzle plate. The first and second catalyst orifices are aligned toward a point down stream from the resin orifice such that catalyst ejected from these orifices intersects a resin fan on opposite sides of the resin fan to mix the catalyst into the resin fan and to shape the resin fan at the intersection point. The first and second gas orifices are also oriented toward a point downstream from the resin orifices however, this point is also aligned downstream with respect to the alignment point of the catalyst orifice such that pressurized gas from the first and second gas orifices intersect the resin fan on opposite sides of the resin fan down stream from and after intersection of the resin fan by the catalyst stream to further shape the resin fan which now includes the catalyst stream intermixed therewith.

The above process can be augmented by co-ejecting pressurized gas with the liquid catalyst from the catalyst orifices such that gas entrained in the catalyst is used to initially shape the resin fan prior to shaping of the resin fan by the gas ejected into the resin fan by the gas orifices.

BRIEF DESCRIPTION OF THE DRAWINGS

This invention will be better understood when taken in conjunction with the drawings wherein:

FIG. 1 is an isometric view of a fragment of a spray gun looking down on the top front of the gun fragment showing the nozzle system of the invention as located on the spray gun;

FIG. 2 is a front elevational view of the nozzle system of the invention;

FIG. 3 is a rear elevational view of the nozzle system of FIG. 2;

FIG. 4 is a top plan view of a fragment of a spray gun showing a nozzle system of the invention located thereon and showing the spray pattern of components ejected from the nozzle system; and FIG. 5 is a side elevational in section about the line 5—5 of FIG. 4.

This invention utilizes certain principles and/or concepts as are set forth in the claims appended hereto. Those skilled in the spray arts will realize that these principles and/or concepts are capable of being utilized in a variety of embodiments which may differ from the exact embodiment utilized for illustrative purposes. For this reason this invention is not to be construed as being limited solely to the illustrative embodiment but should only be construed in view of the claims.

DETAILED DESCRIPTION OF THE INVENTION

In my U.S. application SN 936,364, now U.S. Pat. No. 4,749,128. I describe a spray gun for a plural component system. This spray gun achieves external mixing of a resin and catalyst component. Additionally, this gun allows for either a true airless dispensing of one or both of the resin and the catalyst or dispensing one or both of the resin and the catalyst with air incorporated into the respective component of the plural component system. Both of the resin and the catalyst are dispensed out of the spray gun of this application utilizing hydraulic pressure. If air or other gas is entrained or concurrently dispensed with either the resin or the catalyst, this is achieved by utilizing a hollow needle valve which bleeds the air or the gas into the resin or catalyst in a chamber immediately adjacent the dispensing nozzles for the resin and the catalyst.

In utilizing the gun of my application SN 936,364, depending upon the properties desired in the spray stream and/or the final product, either a true airless or an air assisted spray can be achieved. Conversion from an airless to an air assist of either the resin or catalyst is easily affected by changing a teflon plunger tip on a respective hollow needle valve associated with either the resin or the catalyst dispensing chambers. Further, a "chopper" can be attached to the gun for concurrently dispensing glass fibers into the spray stream of the gun. Such air propelled "choppers" are known and as such further description of these is not deemed necessary to the further understanding of this invention.

The spray gun of my application SN 936,364 can be augmented with a new nozzle plate as is disclosed in greater detail below. Insofar as the structure and the details of the spray gun of my application SN 936,364 are described in that application, for brevity of this specification, that structure will not be repeated instead the entire disclosure of the spray gun of application No. 936,364 is herein incorporated by reference.

In utilizing the nozzle system of this invention in conjunction with the spray gun of my application SN 936,364, generally the resin component will be sprayed from the spray gun in an airless manner. That is, no air will be concurrently mixed with the resin as it is ejected from the gun. If desired, however, the resin could also be sprayed having air or other gas entrained therein by simply changing the teflon needle tip as described above and in greater detail in application SN 936,364.

For spraying of the catalyst component of a plural component system utilizing the nozzle system of the invention, either a true "airless" or an air assisted system can be utilized. If air or other gas is entrained into the catalyst stream, this catalyst stream will now include both a liquid and a gas component and as such it will be hereafter referred to as a fluid component or fluid stream to indicate the fact that it can contain both liquid and gaseous constituents.

In addition to the resin and the fluid streams discussed above, the nozzle system of this invention further includes a dedicated air or gas stream. This air or gas stream contains no liquid components therein and is utilized strictly for shaping of the resin fan emitted from the nozzle system. The spray gun of my application SN 936,364 will be modified slightly from that shown in the drawings of application SN No. 936,364 by including an additional bore, drilling or pathway straight through the gun which connects to a nipple on the back exterior surface of the gun. This bore is used to conduct a pure air or gas stream directly through the gun from an outside source. This air or gas stream is then fed to the nozzle system of the invention for dispensing of the air or gas stream from the nozzle system.

In FIG. 1 of the drawings a spray gun 10 as, for instance, the spray gun of my application SN No. 936,364, is equipped with a nozzle plate 12 of the invention. As is seen in FIG. 1 the spray gun 10 would include a first connecting nipple 14 for supplying resin to the spray gun 10 and a second connecting nipple 16 for supplying catalyst. Resin would be conducted by the connecting nipple 14 from a suitable pressurized resin source to a dispensing chamber generally indicated by the numeral 18 in FIG. 5. In a like manner catalyst would be conducted from a suitable hydraulically pressurized source to a catalyst dispensing chamber 20 also seen in FIG. 5.

Further seen in FIG. 5, is a bore 54 whereby pressurized air is fed from an outside source of pressurized air through the body of the gun 10 to the front of the gun 10. Within the resin dispensing chamber 18 is a teflon valve member 24 which fits over the tip of a resin needle valve 28. In a like manner, a teflon valve member 26 fits over catalyst needle valve 30. For airless dispensing of the resin component, the teflon valve member 24 has a solid tip such that no concurrent air or gas is mixed into the resin allowing for dispensing of the resin in a true "airless manner." The teflon valve member 28, however, has an opening therein allowing for concurrent introduction of air through the hollow catalyst needle valve 30 into the catalyst dispensing chamber 20.

The nozzle plate 12 attaches to the body of the spray gun 10 via two bolts shown in FIG. 1 at 32. This allows for ease of attachment and removal of the nozzle plate 12 from the gun 10. The nozzle plate 12 would attach to the gun 10 in the same manner as a similar nozzle plate was attached to the gun of application SN 936,364.

The nozzle plate 12 has a front surface 34. The front surface 34 is formed as a smooth surface as for instance, a flat surface, or a gently concaved or convexed spherical surface or even a surface of rotation as for instance, an shallow indenting conical surface. It does not includes protruding wings or other features typically found on other spray nozzles as for instance, the protruding wings seen on the nozzle of the above described U.S. Pat. No. 4,618,098. For the purposes of this specification the terminology "smooth" is meant to include flat surfaces, gentle convex or concave surfaces, semi spherical surfaces or surfaces of rotation which, while they can include shallow depressions they would not include extreme recessed or projecting areas. Because of the use of "smooth" surfaces for the face of the nozzle plate, certain orifices as will be described hereinafter are formed by simply drilling into the smooth front surface 34 of the nozzle plate 12.

A shallow aperture 36 i-s formed in the front surface 34 and a further connecting aperture 38 is formed in the rear surface 40 of the nozzle plate 12. The apertures 36 and 38 directly connect to one another for forming a resin dispensing orifice in the nozzle plate 12. A resin tip member 42 is located in the aperture 36 such that its dispensing opening 44 is almost flush with the front surface 34 of the nozzle plate 12.

The resin tip member 42 is formed of a hard resilient material which is resistent to abrasion and the like from a resin component ejected therefrom. This is contrasted to the remainder of the nozzle plate 12 which can be formed of an easier machinable materials as, for instance, an aluminum alloy or the like. The resin tip member 42 is located within the aperture 38 and a teflon 0 ring 46 is placed behind it. The opening in the teflon 0 ring forms a first receiving orifice in the spray plate 12 and the opening in the resin tip member 42 forms an airless dispensing orifice for dispensing of the resin component. Control of the ejection of resin from the airless dispensing orifice in the resin tip member 42 is achieved by movement of the teflon valve member 24 against the exit hole of the resin dispensing chamber 18.

A further aperture 48 is formed in the rear surface 40 of the nozzle plate 12. This serves as a receiving orifice for catalyst and/or catalyst having air or gas entrained therein. This is also fitted with a teflon 0 ring 50. When the nozzle plate 12 is mounted to the spray gun 10 via the bolts 32 the teflon 0 rings 46 and 50 seal against the spray gun 10 such that resin and catalyst are respectively conveyed from their dispensing chambers 18 and 20 into the nozzle plate 12.

A further opening 52 is formed in the back surface 34 of the nozzle plate 12. It is aligned with an air conduit 54 drilled into the body of the spray gun 10. The air conduit 54 is attached to an appropriate air or gas supply for supplying pressurized gas to the opening 52.

First and second fluid conduits 56 and 58 are drilled into the nozzle plate 12 from the upper surface of the nozzle plate 12 down in a V shape such that they each intersect and connect with aperture 48. The upper ends of each of the fluid conduits 56 and 58 are then sealed utilizing threaded plugs collectively identified by the numeral 60. The threaded plugs 60 each have a hex opening in their top surface allowing them to be easily inserted and removed from the nozzle plate 12 if desired.

A first fluid orifice is then drilled in the front surface 34 of the nozzle plate 12 at an acute angle from the front surface 34 until it intersects the first fluid conduit 56. Likewise a second fluid orifice is also drilled at an acute angle in the front surface 34 until it intersects and connects with the second fluid conduit 58. This then forms a fluid pathway from the aperture 48 up through the fluid conduits 56 and 58 such that fluid, i.e. catalyst or catalyst entrained with air or gas can be dispensed from the fluid orifices 62 and 64.

The orifices 62 and 64 are formed in the front surface 34 such that in passing from the front surface 34 toward the rear surface 40, these conduits angle out from a point closer to the center of the resin opening 44 toward the outside periphery of the nozzle plate 12. As so formed fluid ejected from the orifices 62 and 64 is ejected in a stream which meets with and intersects a resin fan ejected from the orifice 44 at a point slightly in front of the orifice 44 and slightly displaced from the front surface 34. Preferredly this point will be within 0.5 inches of the front surface 34. Generally this point will be chosen to be at about 0.25 inches from the front surface 34. Typically the orifices 62 and 64 will be sized to be 0.022 inches in diameter.

A first gas or air conduit 66 is drilled in the lower right hand periphery of the nozzle plate 12 as seen in FIG. 2. In a like manner a second gas conduit 68 is drilled from the same point except at an different angle toward the left hand side of the periphery of the nozzle plate 12 as seen in FIG. 2. A further threaded plug 70 is then inserted in the bottom of these two openings to seal off these two openings, however, both the first and second gas conduit intersect with and therefore connect with the opening 52 in the back surface 40 of the nozzle plate 12.

A first gas discharge orifice 72 is drilled at an acute angle into the front surface 34 such that it intersects the first gas conduit 66. In a like manner a second gas orifice 74 is also drilled into the front surface 34 such that it intersects and is connected to second gas conduit 68. Since the orifices 72 and 74 connect with the gas conduits 66 and 68 which in turn connect with the opening 52, compressed air or gas fed through the bore 22 in the body of the spray gun 10 is directed through and channeled through the nozzle plate 12 such that the gas is ejected from the gas orifices 72 and 74.

The gas orifices 72 and 74 are drilled at an acute angle into the front surface 34 in the same manner as were the fluid orifices 62 and 64. They are oriented such that gas ejected from the gas orifices 72 and 74 meets with and intersects a resin fan ejected from the opening 44. However, gas ejected from the orifices 72 and 74 intersect this resin fan down stream from fluid ejected from the fluid orifices 62 and 64. As such fluid ejected from the fluid orifices 62 and 64 are incorporated into the resin fan prior to impingement of the resin fan with the gas ejected from the gas orifices 72 and 74. Generally the air orifices 62 and 64 will be sized such that they are about 0.0625 inches in diameter and are oriented such that the gas ejected from these orifices strikes the resin fan within about an inch of the front surface 34 preferredly at about 0.5 inch.

Since each of the orifices 62 and 64 and 72 and 74 are drilled at an acute angle to the front surface 34, they form elliptical shaped openings in the front surface 34.

In FIGS. 1, 4 and 5 a resin fan 76, seen both in top view and in side view, is being ejected from the nozzle plate 12. Fluid streams, collectively identified by the numeral 78 first impinge on the resin fan 76 to intermix the catalyst of the fluid stream 78 with the resin fan 76 and to shape the resin fan 76. After the catalyst has been mixed within the resin fan 76 gas streams collectively identified by the numeral 80 then impinge upon the resin fans 76 to further shape the resin fan. It is evident from FIG. 4 that the gas streams 80 serve to enclose the resin streams or fluid streams 78 within a protective envelope. This assists not only in shaping the fan 76, but in insuring better mixing of the catalyst into the resin fan without undue dispensing of the catalyst component into the work place atmosphere. Further, by entraining air within the fluid or catalyst streams 78 via the use of a hollow teflon valve member 76 the resin fan 76 is shaped not only by the gas stream 80 but also by the fluid stream 78. This serves to maximize the desired fan characteristics to eliminate tails or splits in the resin fan 76.

It is evident from the geometry of the spray nozzle system of this invention that the catalyst is entrained into the resin stream as quickly as possible to capture the catalyst into the resin stream to minimize contamination of the environment with the catalyst. Further, as noted above, the catalyst is further contained within the resin fan by the exterior placed air streams.

It is also evident from FIG. 4 that the air stream 80 is essentially parallel with the catalyst stream 78 on both sides of the resin fan 76. This is achieved by drilling the first gas conduit 66 essentially parallel to the first fluid conduit 56 and the second gas conduit 68 essentially parallel to the second fluid conduit 58.

Additionally it is evident from the side view of FIG. 5 that the gas conduits 66 and 68 are displaced rearwardly with respect to the fluid conduits 56 and 58 within the interior of the nozzle plate 12 that is they are displaced rearwardly about an axis extending between the front and rear surfaces of the nozzle plate 12. This allows the cross over of the gas conduit 68 behind the two fluid conduits 66 and 68. As is evident, by utilizing simple drillings or bores in conjunction with threaded plugs the nozzle plate 12 can be easily yet precisionly manufactured and can be easily adapted to different dimensions to fit the dimensions of a spray gun 10 to which it is attached.

For purposes of illustration the nozzle plate 12 shown in the drawing would typically be used for spraying a gel coat. The fan ejected from the nozzle plate 12 would have its major elongated axis along the vertical. If glass fibers are to be incorporated into the resin fan utilizing a "chopper" in conjunction with the spray gun 10, the orifices 74, 64, 66, 56 and 72 would be rotated 90° so as to be aligned along a vertical axis instead of the horizontal axis seen in FIG. 2. This would require slight rearranging of the fluid and gas conduits within the interior of the nozzle plate 12.

It is evident that a variety of nozzle plates utilizing the teachings of this invention can be used for spraying gel coats, fiber incorporated resins or other component systems by simply providing a variety of configurations for the nozzle plates with each easily attaching to a spray gun, as for instance, the spray gun of my application SN 936,364.

In use typically a resin component would be supplied to the nozzle plate 12 at pressures of from 300 to 1000 psi for airless spraying of that resin component. Catalyst would be supplied to the nozzle plate 12 at pressures from 5 to 100 psi and if gas or air was entrained into this catalyst it would also be supplied at the same pressure range of from about 5 to 100 psi. The air or gas utilized in the outside gas streams would be supplied at varying pressures up to 100 psi.

What is claimed is:

1. A nozzle system for a plural component spray gun which comprises:

a nozzle plate;

an airless discharge orifice located in said nozzle plate;

first and second fluid discharge orifices located in said nozzle plate in association with said airless discharge orifice, said first fluid discharge orifice located on one side of said airless discharge orifice and said second fluid discharge orifice located on the opposite side of said airless discharge orifice;

first and second gas discharge orifices located in said nozzle plate in association with both said airless discharge orifice and said first and second fluid discharge orifices, said first gas discharge orifice located adjacent to and outboard of said first fluid discharge orifice positioning said first fluid discharge orifice between said first gas discharge orifice and said airless discharge orifice, said second gas discharge orifice located adjacent to and outboard of said second fluid discharge orifice positioning said second fluid discharge orifice between said second gas discharge orifice and said airless discharge orifice;

means for supplying a component of a plural component system to said airless discharge orifice;

means for supplying a second component of said plural component system to said first and second fluid discharge orifices; and means for supplying a gas to said gas discharge orifice.

2. A nozzle system of claim 1 wherein:

said first and second gas discharge orifices, said first and said second fluid discharge orifices and said airless discharge orifice are all aligned in a linear array on said nozzle plate with said gas discharge orifices at the respective ends of said linear array, said airless discharge orifice in the center of said array and said fluid discharge orifices intermediate said ends and said center of said array.

3. A nozzle system of claim 1 wherein:

said nozzle plate includes an essentially smooth front surface with each of said airless discharge orifice, said first and second fluid discharge orifices and said first and second gas discharge orifices opening into said smooth surface of said plate.

4. A nozzle system of claim 1 wherein:

said airless discharge orifice includes a nozzle insert position in said nozzle plate; and said first and second fluid discharge orifices and said first and second gas discharge orifices each comprising an opening formed in said nozzle plate.

5. A nozzle system of claim 4 wherein:

said nozzle plate includes a smooth front surface;

said nozzle plate including a nozzle chamber formed in said nozzle plate and extending into said smooth front surface; and said nozzle insert located in said nozzle chamber.

6. A nozzle system of claim 5 wherein:

said nozzle insert is positioned in said nozzle chamber in a location recessed into said smooth front surface; and each of said first and second fluid discharge orifices and said first and second gas discharge orifices opening in said smooth surface.

7. A nozzle system of claim 6 wherein:

said front surface is flat; and the opening of each of said first and second fluid discharge orifices and said first and second gas discharge orifices being located in the plane of said flat surface at an acute angle such that they are elliptical in shape.

8. A nozzle system of claim 3 wherein:

said first and second gas discharge orifices, said first and second fluid discharge orifices and said airless discharge orifice are all aligned in a linear array on said nozzle plate with said gas discharge orifices at the respective ends of said linear array, said airless discharge orifice in the center of said array and said fluid discharge orifices intermediate said ends and said center of said array.

9. A nozzle system for a plural component spray gun which comprises:

a nozzle plate;

an airless discharge orifice located in said nozzle plate;

first and second fluid discharge orifices located in said nozzle plate in association with said airless discharge orifice, said first fluid discharge orifice located on one side of said airless discharge orifice and said second fluid discharge orifice located on the opposite side of said airless discharge orifice;

first and second gas discharge orifices located in said nozzle plate in association with both said airless discharge orifice and said first and second fluid discharge orifices, said first gas discharge orifice located adjacent to and outboard of said first fluid discharge orifice positioning said first fluid discharge orifice between said first gas discharge orifice and said airless discharge orifice, said second gas discharge orifice located adjacent to and outboard of said second fluid discharge orifice positioning said second fluid discharge orifice between said second gas discharge orifice and said airless discharge orifice;

means for supplying a component of a plural component system to said airless discharge orifice;

means for supplying a second component of said plural component system to said first and second fluid discharge orifices;

means for supplying a gas to said gas discharge orifice;

said nozzle plate includes an essentially smooth front surface with each of said airless discharge orifice, said first and second fluid discharge orifices and said first and second gas discharge orifices opening into said smooth surface of said plate;

said nozzle plate further includes a back surface;

said means for supplying a component of a plural component system to said airless discharge orifice comprising a first receiving orifice formed in said back surface, said first receiving orifice directly connecting to said airless discharge orifice for supply a first component of a plural component system to said airless discharge orifice;

said means for supplying a second component of said plural component system to said first and second fluid discharge orifices comprising a second receiving orifice and a fluid conduct means, said second receiving orifice formed in said back surface, said fluid conduct means extending from said second receiving orifice to said first and said second fluid discharge orifices respectively; and said means for supplying a gas to said gas discharge orifice comprising a third receiving orifice and a gas conduct means, said third receiving orifice formed in said back surface, said gas conduct means extending from said third receiving orifice to said first and said second gas discharge orifices respectively.

10. A nozzle system of claim 9 wherein:

said fluid conduct means includes first and second fluid conducts;

said gas conduct means includes first and second gas conducts; and said first and said second fluid conducts are axially displaced with respect to said first and said second gas conducts between said front and said back surfaces of said nozzle plate about an axis extending between said front and back surfaces of said nozzle plate.

11. A nozzle system of claim 1 wherein:

said first and said second gas discharge orifices are of a cross sectional area which is greater than the cross sectional area of said first and second fluid discharge orifices.

12. A nozzle system of claim 1 wherein:

said nozzle plate includes a smooth front surface;

said first and said second fluid discharge orifices are oriented at an acute angle to said front surface and are directed towards one another such that fluid streams exiting said respective first and second fluid discharge orifices are directed towards one another and impinge upon a component stream discharged from said airless discharge orifice on the opposite side of said component stream discharged from said airless discharge orifice.

13. A nozzle system for a plural component spray gun which comprises:

a nozzle plate;

an airless discharge orifice located in said nozzle plate;

first and second fluid discharge orifices located in said nozzle plate in association with said airless discharge orifice, said first fluid discharge orifice located on one side of said airless discharge orifice and said second fluid discharge orifice located on the opposite side of said airless discharge orifice;

first and second gas discharge orifices located in said nozzle plate in association with both said airless discharge orifice and said first and second fluid discharge orifices, said first gas discharge orifice locate adjacent to and outboard of said first fluid discharge orifice positioning said first fluid discharge orifice between said first gas discharge orifice and said airless discharge orifice, said second gas discharge orifice located adjacent to and outboard of said second fluid discharge orifice positioning said second fluid discharge orifice between said second gas discharge orifice and said airless discharge orifice;

means for supplying a component of a plural component system to said airless discharge orifice;

means for supplying a second component of said plural component system to said first and second fluid discharge orifices;

means for supplying a gas to said gas discharge orifice;

said nozzle plate includes a front surface;

said first and said second fluid discharge orifices are oriented at an acute angle to said front surface and are directed towards one another such that fluid streams exiting said respective first and second fluid discharge orifices are directed towards one another and impinge upon a component stream discharged from said airless discharge orifice on the opposite side of said component stream discharged from said airless discharge orifice; and said first and said second gas discharge orfice are oriented at an acute angle to said front surface and are directed towards one another such that gas streams exiting said respective first and second gas discharge orifices are directed towards one another and impinge upon a component stream discharged from said airless discharge orifice on opposite side of said component stream discharged from said airless discharge orifice.

14. A nozzle system of claim 13 wherein:

said fluid streams from said respective first and second fluid discharge orifices impinge upon said component stream from said airless discharge orifice proximal to said airless discharge orifice and said gas stream from said respective first and second gas discharge orifices impinge upon said component stream down stream from the impingement point of said fluid streams.

15. A nozzle system of claim 13 wherein:

said respective fluid streams from said first and second fluid discharge orifices impinge on said component stream at a point less then about 0.5 inches from said airless discharge orifice and said respective gas streams from said first and second gas discharge orifices impinge on said component stream at a point less than about 1 inch from said airless discharge orifice.

16. A nozzle system of claim 13 wherein:

said respective fluid streams from said first and second fluid discharge orifices and said respective gas streams from said first and second gas discharge orifices are essentially parallel to one another.

17. A nozzle system of claim 1 wherein:

said means for supplying said second component of said plural component system to said first and second fluid discharge orifices includes means for supplying both a liquid portion of said component and a gas portion of said component such that said second component discharged from said first and second fluid discharge orifices comprises a mixture of a liquid and a gas.

18. A nozzle system for a plural component spray gun consisting of:

a nozzle plate;

a resin discharge orifice located in said nozzle plate;

first and second catalyst discharge orifices located in said nozzle plate in association with said resin discharge orifice, said first catalyst discharge orifice located on one side of said resin discharge orifice and said second catalyst discharge orifice located on the opposite side of said resin discharge orifice;

first and second gas discharge orifices located in said nozzle plate in association with both said resin discharge orifice and said first and second catalyst discharge orifices, said first gas discharge orifice located adjacent to and outboard of said first catalyst discharge orifice positioning said first catalyst discharge orifice between said first gas discharge orifice and said resin discharge orifice, said second gas discharge orifice located adjacent to and outboard of said second catalyst discharge orifice positioning said second catalyst discharge orifice between said second gas discharge orifice and said resin discharge orifice;

means for supplying a pressurized resin component of a plural component system to said resin discharge orifice;

means for supplying a pressurized catalyst component of said plural component system to said first and second catalyst discharge orifices; and means for supplying pressurized gas to said gas discharge orifice.

19. A nozzle system of claim 18 wherein:

said first and second gas discharge orifices, said first and said second catalyst discharge orifices and said resin discharge orifice are all aligned in a linear array on said nozzle plate with said gas discharge orifices at the respective ends of said linear array, said resin discharge orifice in the center of said array and said catalyst discharge orifices intermediate said ends and said center of said array.

20. A nozzle system of claim 18 wherein:

said nozzle plate includes a smooth front surface and each of said resin discharge orifice, said first and second catalyst discharge orifices and said first and second gas discharge orifices open into said smooth surface of said plate.

21. A process of spraying a plural component systems which comprises:

locating a resin orifice in a nozzle plate;

locating first and second catalyst orifice in said nozzle plate on respective sides of said resin orifice;

locating first and second gas orifices in said nozzle plate on respective sides of said resin orifice outwardly of said respective first and second catalyst orifices from said resin orifice such that said respective orifices are aligned in an array comprising said first gas orifice, said first catalyst orifice, said resin orifice, said second catalyst orifice and said second gas orifice respectively;

orienting said first and second catalyst orifices towards a point downstream from said resin orifice;

orienting said first and second gas orifices towards a point downstream from said resin orifice and further downstream from said alignment point of said catalyst orifices;

airlessly supplying pressurized resin to said resin orifice to airlessly spray said resin in a fan from said resin orifice;

supplying pressurized catalyst to said first and second catalyst orifices to spray first and second catalyst streams from said catalyst orifices and to intersect said resin fan with first and second catalyst streams on opposite sides of said resin fan to mix catalyst into said resin fan and to shape said resin fan at said intersection point of said catalyst with said resin fan; and supplying pressurized gas to said first and second gas orifices to spray first and second gas streams from said first and second gas orifices and to intersect said first and second gas streams with said resin fan on opposite sides of said resin fan downstream from said catalyst streams intersection point will said fan to further shape said resin fan.

22. The process of claim 21 further including:

co-ejecting pressurized gas with said catalyst from said first and second catalyst orifices to eject fluid streams from said catalyst orifices which include gas entrained in said catalyst to shape said resin fan with both said catalyst component and said gas component ejected from said catalyst orifice.

* * * * *

UNITED STATES PATENT AND TRADEMARK OFFICE

CERTIFICATE OF CORRECTION

PATENT NO. : 4,928,884

DATED : MAY 29, 1990

INVENTOR(S) : GARY L. SMITH

It is certified that error appears in the above-identified patent and that said Letters Patent is hereby corrected as shown below:

Column 1, line 34, "on of" should be --of--.

Column 1, line 57, "increase" should be --increases--.

Column 4, line 1, "of the of the" should be --of the--.

Column 4, line 47, insert --view-- between "elevational" and "in".

Column 6, line 34, "an" should be --a--.

Column 6, line 48, "i-s" should be --is--.

Column 6, line 60, "materials" should be --material--.

Column 7, line 54, "an" should be --a--.

Column 10, line 11, "position" should be --positioned--.

Column 12, line 11, "locate" should be --located--.

Column 12, line 37, "orfice" should be --orifice--.

Column 12, line 43, "side" should be --sides--.

Column 14, line 9, "orifice" should be --orifices--.

Column 14, line 41, "will" should be --with--.

Signed and Sealed this

Twenty-fifth Day of August, 1992

*Attest:*

*Attesting Officer*

DOUGLAS B. COMER

*Acting Commissioner of Patents and Trademarks*